US005138813A

United States Patent [19]

Cooney et al.

[11] Patent Number: 5,138,813

[45] Date of Patent: Aug. 18, 1992

[54] BUILDING CONSTRUCTION METHOD AND CONCRETE PANEL FOR USE THEREIN

[75] Inventors: Frank J. Cooney, Lake Worth; Donald H. Dworkes, Margate, both of Fla.

[73] Assignee: Novatek International, Inc., Boynton Beach, Fla.

[21] Appl. No.: 570,516

[22] Filed: Aug. 21, 1990

[51] Int. Cl.[5] ..... E04C 2/06

[52] U.S. Cl. ..... 52/600; 52/704; 52/787

[58] Field of Search ..... 52/125.5, 126.4, 225, 52/701, 706, 787, 722, 704, 600, 511

[56] References Cited

U.S. PATENT DOCUMENTS

| | | | |
|---|---|---|---|
| 1,433,219 | 10/1922 | Newell | 52/722 X |
| 4,602,467 | 7/1986 | Schilger . | |
| 4,727,701 | 3/1988 | Figari . | |
| 4,909,009 | 3/1990 | Ogawa et al. . | |

FOREIGN PATENT DOCUMENTS

| | | | |
|---|---|---|---|
| 1166250 | 10/1969 | United Kingdom | 52/706 |

*Primary Examiner*—Michael Safavi

*Attorney, Agent, or Firm*—James A. Quinton; Frank Frisenda, Jr.

[57] ABSTRACT

A pre-fabricated cement or concrete panel and an improved system for building construction using such panels is provided. The concrete panel has a threaded tubular connector (concrete insert) imbedded therein for receipt of a bolt. The tubular connector has a head portion, a spaced flange portion and a tubular bolt receiving body portion for receipt of the securing bolt. The flange is securely attached to the tubular bolt receiving body by any convenient method such as welding or crimping. Reinforcement bars are imbedded in the panels on each side adjacent to the periphery of the panel. The flange is placed at a predetermined position between the head and the open end of the bolt receiving body. The predetermined distance between the flange and the head is dependent on the diameter of the reinforcement bars. The distance is selected to allow receipt of reinforcing bars which are placed around the periphery of the cement panels so that the bars sit on the flange and nest against the bolt body in pressure engagement between the bolt head and the flange.

4 Claims, 3 Drawing Sheets

BUILDING CONSTRUCTION METHOD AND CONCRETE PANEL FOR USE THEREIN

BACKGROUND OF THE INVENTION

1. Field of the Invention

The subject invention relates to improved concrete building panels and and improved system for construction of concrete buildings.

2. Description of the Prior Art

There is a wide array of building panels available in the prior art. Building panels have been designed so that overhanging tongue in groove connectors or shoulders align to provide a tight fit. See, for example, U.S. Pat. No. 4,727,701. In addition, nuts have been imbedded in panels to receive bolts so the panels may be anchored into place. See, for example, U.S. Pat. Nos. 4,727,701 and 4,909,009. It is important that such nuts are firmly imbedded in the concrete so the nuts are not pulled from the concrete when the panels are bolted to the supporting frame. It is also important that the nuts do not migrate to the outer surface and crack the panels. It is known in the prior art to provide metal reinforcing bars around the periphery of the panels. However, location of the bars during manufacture and migration of the bar to the surface of the frame can be a problem.

C-channels have been used in the prior art to support cement or concrete building panels. See for example, U.S. Pat. No. 4,602,467. In addition I-beams have been used to provide such support. I-beams provide superior strength to C-channel construction due to increased mass and strength provided by the I-beams. However, I-beams are expensive and are difficult to work with due to their weight. Construction of I-beam frames need to be done on site, and often require the use of heavy equipment such as cranes.

SUMMARY OF THE INVENTION

The present invention is directed to an improved prefabricated cement or concrete panel and an improved system for building construction using such panels. According to the invention, a concrete panel is provided having a threaded tubular connector (concrete insert) imbedded therein for receipt of a bolt. The tubular connector has a head portion, a spaced flange portion and a tubular bolt receiving body portion for receipt of the securing bolt. The flange is securely attached to the tubular bolt receiving body by any convenient method such as welding or crimping. Reinforcement bars are imbedded in the panels on each side adjacent to the periphery of the panel. The flange is placed at a predetermined position between the head and the open end of the bolt receiving body. The predetermined distance between the flange and the head is dependent on the diameter of the reinforcement bars. The distance is selected to allow receipt of reinforcing bars which are placed around the periphery of the cement panels so that the bars sit on the flange and nest against the bolt body in pressure engagement between the bolt head and the flange.

As a result, a concrete panel which is less likely to fail due to cracking or connector failure is provided with reinforcement bars and imbedded connectors. According to the invention, the likelihood of migration of the reinforcement bars and the connectors to the outside surface of the panel is reduced. Thus, a panel which is resistant to cracking as a result of migration of imbedded bars and connectors is provided.

In another aspect of the invention, the prefabricated panels are erected on a building frame composed of pairs of structural C-channels (hereinafter referred to as C-channels) mounted back to back. Each panel is then secured to an individual C-channel at each end. A bolt is provided for mounting a connector preferably U-shaped on said panel through the tubular connector provided in the corners of the panels. Preferably, the building frame is erected from components assembled off-site. Each component is composed of a number of pairs of back to back C-channel secured to a horizontal steel frame which in turn is secured to a concrete slab. Each frame is portable and can be erected by one or two men without the use of heavy equipment. The resulting structure provides support comparable to that of I-beam construction with regard to wind resistance and overall strength and stability.

The preferred embodiment of the present invention is illustrated in the drawings. However, it should be expressly understood that the present invention should not be limited solely to the illustrative embodiment.

DETAILED DESCRIPTION OF THE DRAWINGS

DETAILED DESCRIPTION OF THE INVENTION

Figure 1:
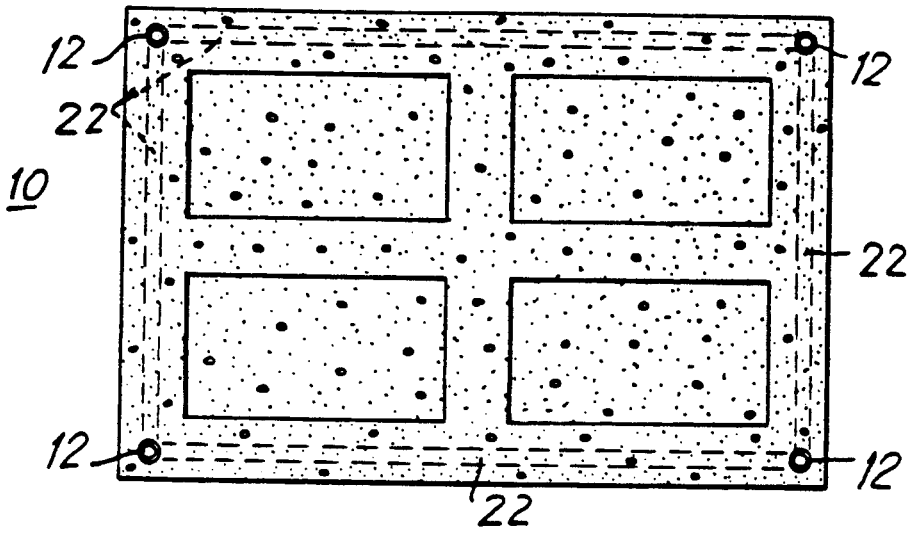
FIG. 1 is an elevational view of a concrete panel viewed from the outside of the building.
Figure 2:
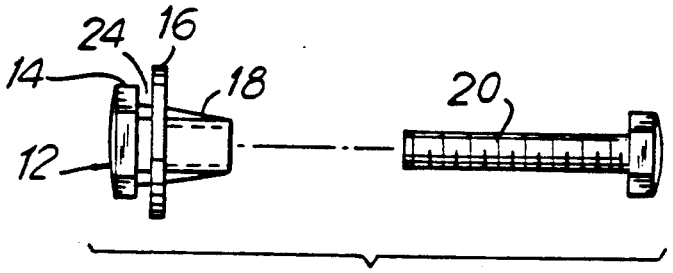
FIG. 2 is a sideview of the tubular connector (concrete insert) and the bolt for insertion therein.

The present invention relates to an improved prefabricated concrete or cement panel and an improved system for building construction using such panels. The concrete panel according to the invention has a threaded tubular connector imbedded therein for receipt of a bolt for securing the panel to a supporting structure. The tubular connector has a head portion, a spaced flange portion and a tubular bolt receiving body portion. The flange is securely but flexibly attached to the tubular bolt receiving body. The flange can be attached thereto by any convenient method such as welding or crimping. Reinforcement bars are provided around the perimeter of the concrete panel and imbedded therein.

According to the invention, during the manufacture of the panel, the reinforcement bars are snapped into the space between the flange and the head portion of the tubular connector. The space between the flange and the head portion of the connector is selected to snugly receive and hold the reinforcement bars in place in the concrete panel after curing. The flange is somewhat flexible so as to allow a snap engagement of the reinforcement bar into the space between the flange and the head of the tubular connector. Migration of the reinforcing bars is retarded as a result of the securing force of the tubular connector on the bars and hence, the likelihood that the panel will crack is reduced. As a result of the increased area of the flange attached to the tubular connectors, shorter tubular connectors can be used to provide similar strength and resistance to failure of the connectors by pulling forces as a result of the weight of the panels or from hurricanes or other stress on the building. Since shorter connectors can be used, there is less likelihood that the tubular connectors will migrate to the surface of the panels. Besides as loss of aesthetic appeal, if the connector migrates to the outside surface of the panel, the panel may crack. In addition, the connector then would be subject to corrosion and hence, more likely to fail.

In another aspect of the invention, portable prefabricated structural frames are provided. The frames are provided in sections or components and are of such a size and weight that they can be easily handled by one or two men without the use of heavy machinery such as cranes and the like. The frames are composed of back to back C-channels secured to a horizontal steel frame. According to the invention the componentized frame is then secured to a concrete slab to form the building frame. Each end of the panels is secured to a C-channel. The abutting panel is secured to the other C-channel of the back to back pair. The resulting structure provides support comparable to that of I-beam construction with regard to wind resistance and overall strength and stability. Desirably each componentized frame section is composed of from 2 to 10 back-to-back C-channels preferably, 5 back-to-back C-channels. Each frame section is attached to the adjoining section preferably by employing a splice plate.

As can be best seen with reference to the drawings, the precast concrete panels 10 according to the invention are provided with a threaded tubular connector 12 at each corner of the panel. The tubular connector has a head 14, a flange 16 which is located a predetermined distance from the head 14 and a tubular bolt receiving body 18 for receipt of securing bolt 20. Reinforcement bars preferably rods 22 are located around the periphery of the concrete panel 10. As can be best seen in FIG. 3 the reinforcement bars 22 are received in the space 24 between the head 14 and flange 16. The space 24 is preselected depending on the bar diameter so that the bar may snugly fit in between the head and flange for pressure engagement therebetween and be held in position against the bolt receiving body 18. Desirably reinforcement bars of ⅛ to ½ inch are used. Preferably a reinforcement bar of ¼" diameter is used in a 2" thick panel. Preferably the flange 16 is flexibly mounted so that the rods 22 can be easily but securely snapped into place. As a result, the rods 22 are located in the desired position in the panel during the pouring of the concrete. In addition, migration of the rods is retarded after curing by the action of the head and the flange of the imbedded tubular connector on the rods. Desirably the concrete panels may include reinforcing fibers for example, chopped structural polypropylene fibers such as those sold under the trademarks FIBER-AD-TYPE I, II or III produced by Fiber Ad Corp., Charlotte, N.C.

Preferably the flange 16 has a diameter at least two times the diameter of the bolt receiving body 18. The diameter of the flange 16 is typically larger than the diameter of the head. Preferably, the flange 16 diameter is 25% larger than that of the head 14. As a result of the increased surface area provided by the flange imbedded in the concrete, the connector is more firmly imbedded in the concrete. As a result, a shorter connector 12 can be used in the panel without any reduction in strength. As a result, the shorter tubular connector is more deeply imbedded in the panel and is less likely to migrate to the surface.

The tubular connector 12 length can be reduced from ¼ to ¾ of the length of a typical connector, and preferably about 3/5 the length of a typical connector. For a 2" panel 10 a tubular connector 1.0 inch long can be effectively used whereas a typical connector would be 1.5 inches long.

Figure 3:
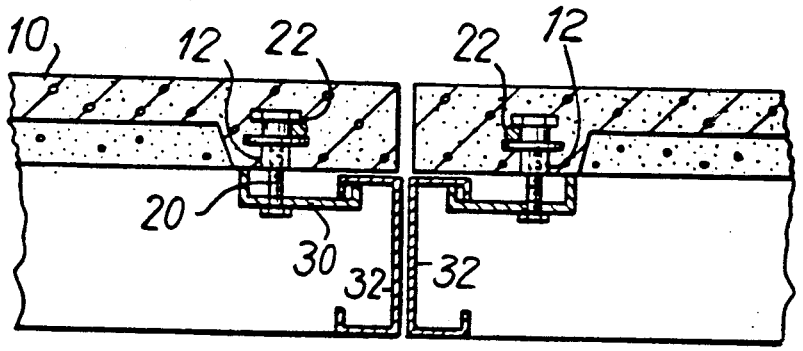
FIG. 3 is a plan view of a typical connection of the panel and the C-channels according to the invention.

As best seen in FIG. 3, the concrete panels 10 are secured in place with bolts 20 which are received by the threaded tubular connector 12 imbedded in the concrete panel 10. U-shaped clip 30 is provided for securing the concrete panel to C-channels 32. On each side of the concrete panel 10, the panel is secured to the C-channel in two positions. The mating adjoining panel is similarly secured to the opposite C-channel of the back to back pair as shown. The clip 30 is bolted into place to hold the panel to the C-channel through bolt 20 which is in threaded engagement with the tubular connector 12 imbedded in the concrete panels 10. The panels 10 interlock with one another on the sides, top and bottom thereof by mating tongue-in-groove shoulders located on the side of each panel so that each panel firmly mates with an adjoining panel.

Figure 4:
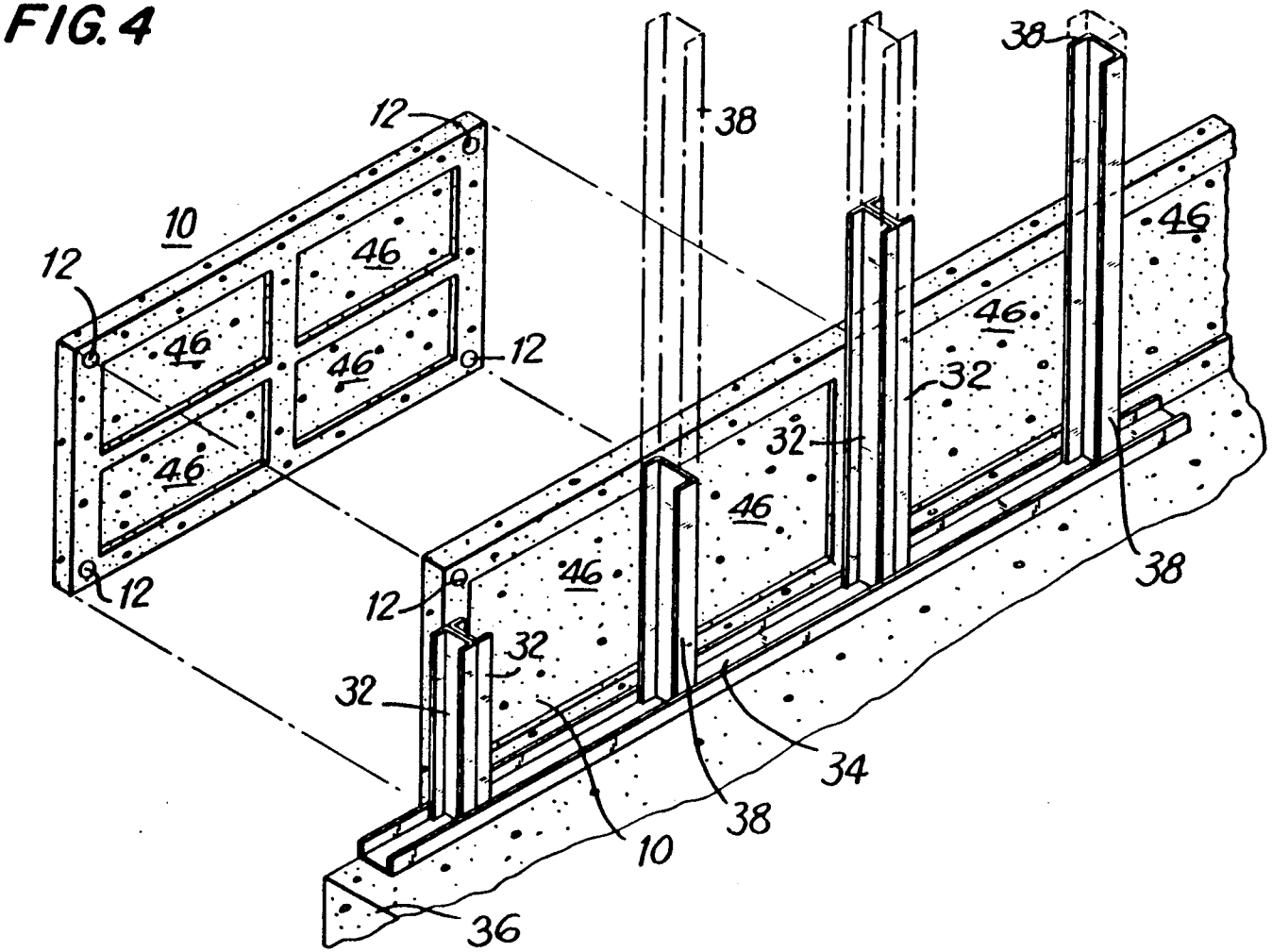
FIG. 4 is an isometric view of a wall made with panels according to the invention.

As best seen in FIG. 4, the building frame components are composed of back to back C-channels 32 secured to a steel frame 34 by welding or mechanical fastening, e.g., bolting or screwing. Frame 34 is in turn mounted through bolts or the like to slab 36. The back-to-back C-channel (or C-channel pairs) are spaced from one another at a distance equal to the width of the panels 10. Intermediate each C-channel pair are single C-channel 38 which when the panels 10 are mounted to the C-channel pairs 32 the single C-channel abuts the middle of panel 10. The single C-channel 38 aids in the alignment of the panels, adds to rigidity and increases the load bearing capability of the wall section.

Figure 5:
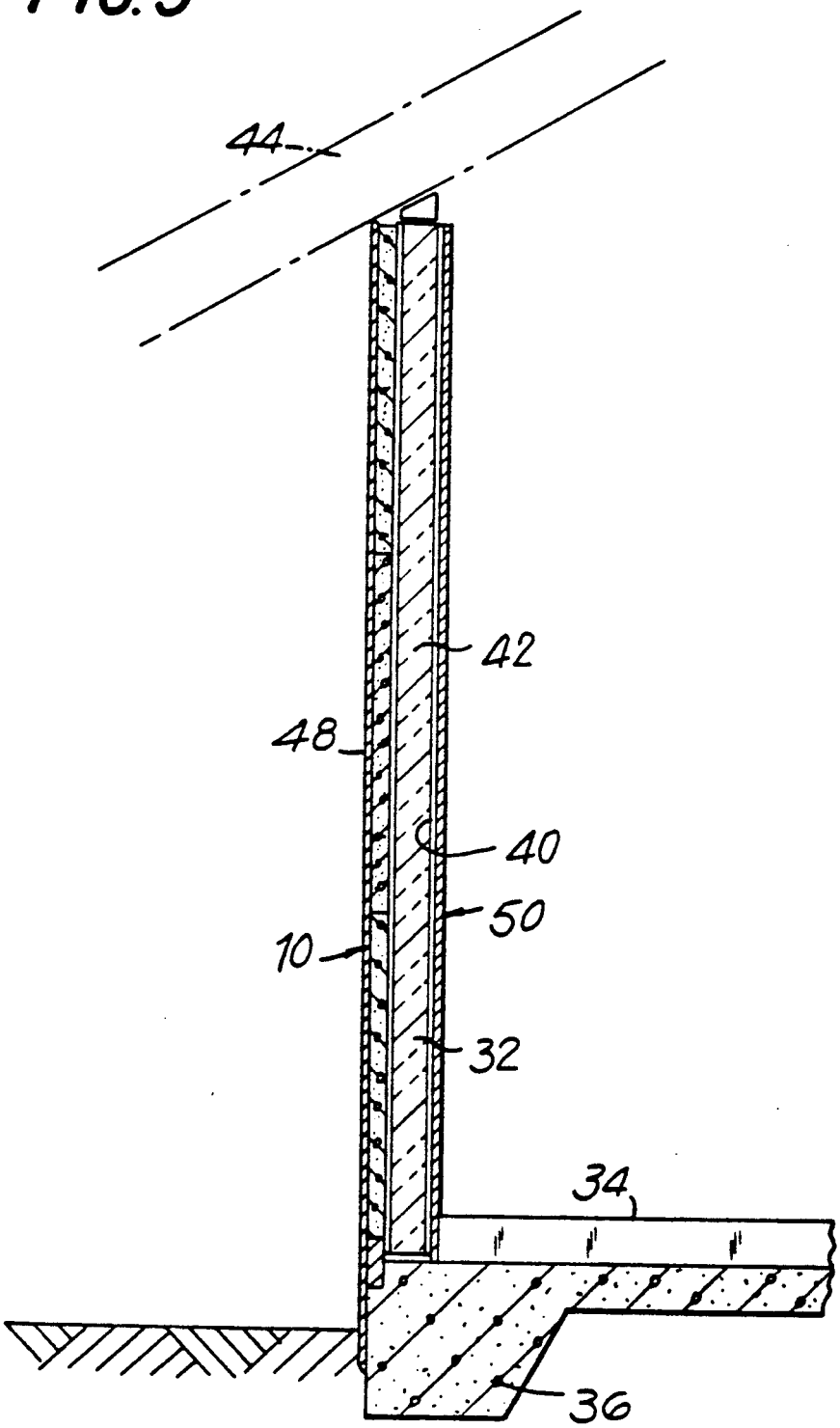
FIG. 5 is a wall section of a typical structure according to the invention.

As best seen in FIG. 5, a wall erected according to the subject invention is strong and energy efficient. The wall exterior finish 48 can for example, be stucco on the exterior of the panels 10. The C-channels 32 have a hollow space 40 which preferably can be filled with insulation 42. Wall board 50 is provided to give a smooth interior. The wall is then connected to the roofing system which varies, depending on design. The steel frame can be a steel runner 34 which is anchored to the concrete slab or foundation 36. Preferably panel 10 includes rectangular recesses 46 which when erected provides an insulating air space in the wall. The resulting structure is strong and wind resistant and provides substantially the same strength as I-beam construction.

The foregoing is considered as illustrative only of the principles of the invention. Further, since numerous changes and modifications will occur to those skilled in the art, it is not desired to limit the invention to the exact construction and operation shown and described above, and accordingly all suitable modifications and equivalents may be resorted to, falling within the scope of the invention.

We claim:

1. A precast concrete panel adapted for nesting securely side by side to form a building wall comprising:

reinforcement bars imbedded along the periphery of the four sides of said panel;

each said reinforcement bar being perpendicular to each adjacent reinforcement bar;

threaded concrete inserts imbedded adjacent each corner of said panel for receipt of securing bolts to mount the panel to a frame;

said concrete inserts having a head, a bolt receiving body, and an annular flange flexibly secured to said bolt receiving body so that said flange is resiliently flexed during the placement of said reinforcement bar into position between said head and said annular flange said annular flange spaced from said head a sufficient distance to allow receipt of adjacent perpendicular reinforcement bars and nesting of said reinforcement bars in pressure engagement between said annular flange and said head so that said reinforcing bars are retained in the desired position in said panel and migration of said bars to the surface of said panel is retarded;

each concrete insert having adjacent perpendicular reinforcement bars at each corner snapped into pressure engagement between said head and said annular flange.

2. The concrete panel of claim 1 wherein the diameter of said flange is at least twice the diameter of said bolt receiving body.

3. The concrete panel of claim 2 wherein the diameter of said flange is larger than the diameter of said bolt head.

4. The concrete panel of claim 3 wherein the diameter of said flange is at least 25% larger than that of the diameter of said bolt head.

* * * * *